United States Patent [19]

Kassal et al.

[11] Patent Number: 4,728,123

[45] Date of Patent: Mar. 1, 1988

[54] RELEASABLE STRAP SYSTEM

[76] Inventors: Randy Kassal, 2519 N. Ocean Blvd., #316; Jim Juday, 940 Sweetwater La., #501, both of Boca Raton, Fla. 33431

[21] Appl. No.: 32,296

[22] Filed: Mar. 30, 1987

[51] Int. Cl.[4] ..... A63C 11/22

[52] U.S. Cl. ..... 280/822; 224/220

[58] Field of Search ..... 280/819, 821, 822; 2/170, DIG. 6; 224/220, 221

[56] References Cited

U.S. PATENT DOCUMENTS

| | | | |
|---|---|---|---|
| 2,553,317 | 5/1951 | Hill | 224/221 |
| 3,170,703 | 2/1965 | Marchand | 2/160 X |
| 3,218,089 | 11/1965 | Marchand | 2/160 X |
| 3,232,632 | 2/1966 | Lewis | 280/822 |
| 4,315,641 | 2/1982 | Larsen | 280/822 |
| 4,489,867 | 12/1984 | Schwemberger | 224/220 X |
| 4,653,121 | 3/1987 | Kassal et al. | 280/822 X |

FOREIGN PATENT DOCUMENTS

| | | | |
|---|---|---|---|
| 24107 | of 1895 | United Kingdom | 224/220 |

*Primary Examiner*—John J. Love
*Assistant Examiner*—Michael Mar
*Attorney, Agent, or Firm*—Malin, Haley & McHale

[57] ABSTRACT

A releasable strap system and, more particularly, to the combination of a hand strap and a device strap for an item. The hand strap is removably connectable around the wrist of a hand and between two of the five fingers of the hand leaving the hand free for normal use. The device strap is removably connected to the hand strap for supporting an item not held in the hand of a user and for quick release from the hand strap.

1 Claim, 5 Drawing Figures

RELEASABLE STRAP SYSTEM

BACKGROUND OF THE INVENTION

This invention relates to a releasable strap system and, more particularly, to the combination of a hand strap and a device strap for an item. The hand strap is removably connectable around the wrist of a hand and between two of the five fingers of the hand leaving the hand free for normal use. The device strap is removably connected to the hand strap. The device strap can be easily and quickly released from the hand strap in the event of an emergency. The device strap is used to support tools, etc. that fall out of the user's hand.

Releasable straps have been used in many environments such as in skiing. In the past straps such as shown in U.S. Pat. Nos. 4,315,641, to Larsen, 3,232,632 to Lewis, and 3,170,703 and 3,218,089 both to Marchand have been used to interconnect a user to a ski pole.

It would be desirable to have a universal strap that would be useable over a person's hand or over the user's glove. A ski strap system was disclosed by the applicants in U.S. patent application Ser. No. 685,720 filed on Dec. 24, 1984 now U.S. Pat. No. 4,653,121. The U.S. patent application Ser. No. 685,720 is incorporated in this application by reference and is made a part hereof.

SUMMARY OF THE INVENTION

This invention is to a new and improved releasable strap system that includes a hand strap and a device strap. The hand strap includes two portions, a straight wrist portion and a curved loop portion. The loop portion has two ends connected to the straight portion at separated intervals. The loop potion includes a first mating surface of a hook and loop connector such as a VELCRO connecting system. The straight portion includes a connector ring or oval connector at one end and one mating surface of a hook and loop connector means at the other end with the second mating surface of the hook and loop connector means positioned along the surface of the straight portion. The straight portion is wrapped around the wrist of a user and threaded through the ring and tightened and folded back and locked in position by mating the one mating surface on the second mating surface. A device strap may be a straight band that includes a mating surface of a hook and loop connector means on one side for releasably connecting the device strap to the hand strap. The device strap also includes connector means for connecting tools and other items to the device means.

In use the wrist strap of the hand strap is placed around a wrist and looped through the ring to tighten it on the wrist and connected on itself by the VELCRO connector to temporarily fix the wrist strap on the wrist. The loop portion is placed between two fingers. The loop portion is preferably placed between the thumb and a finger. The device strap is connected to a tool or other item and is also mated with the VELCRO connector on the loop portion.

In accordance with these and other objects which will be apparent hereinafter, the instant invention will now be described with particular reference to the accompanying drawings.

BRIEF DESCRIPTION OF THE DRAWINGS

One preferred embodiment of the subject invention is hereafter described with specific reference being made to the following figures, in which.

DESCRIPTION OF THE PREFERRED EMBODIMENT

Figure 1:
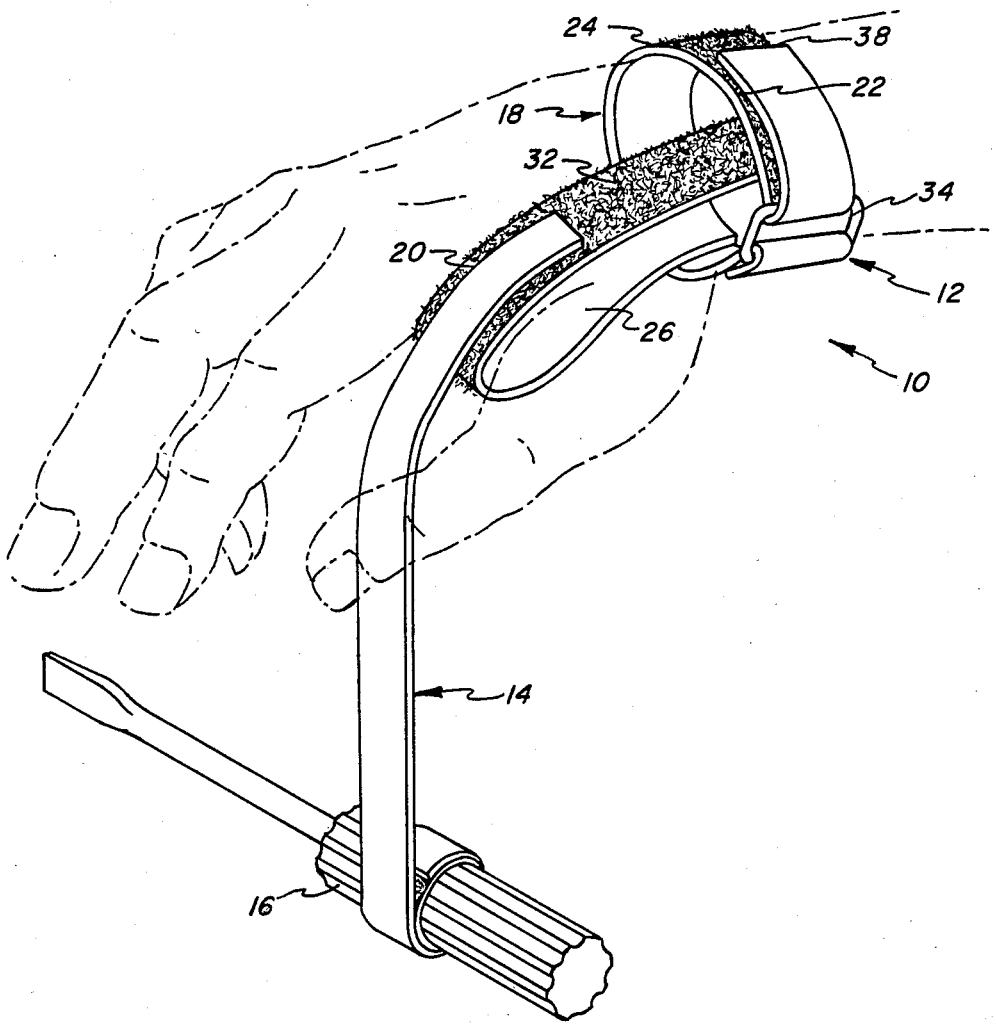
FIG. 1 is an isometric view of the releasable strap system including the hand strap and the device strap connected to a screwdriver.
Figure 2:
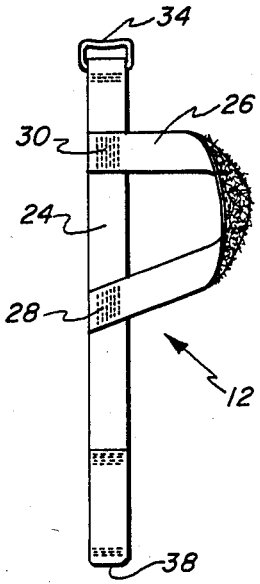
FIG. 2 shows an underside of the hand strap.

One preferred embodiment of the subject invention is shown in FIG. 1, the releasable strap system 10, includes a hand strap 12 and a device strap 14 for an item, such as screwdriver 16. Other tools, nails, screws or other hand held items may be connected to the user by the releasable strap system. The hand strap 12 is removably connectable around the wrist of a user's hand. The wrist fits into opening 18. The hand strap also fits between two of the user's five fingers on the user's hand. The releasable strap system leaves the user's hand free for normal use while the device strap 14 still holds the screwdriver 16. The device strap 14 is removably connected to the hand strap 12 for supporting an item not held in the hand of a user. The device strap 14 is quickly released from the hand strap 12 by a releasable hook and loop connector 20. The hand strap 12 is held on the wrist by a releasable hook and loop connector 22.

Figure 3:
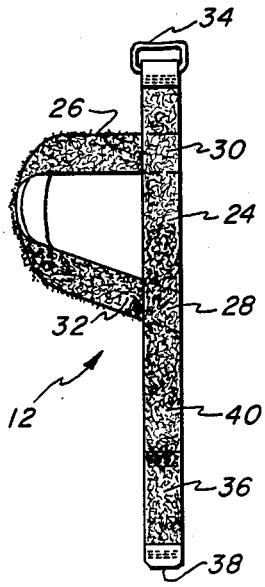
FIG. 3 shows the top side of the hand strap.

This invention shown in FIGS. 2, 3, 4 and 5 is to a new and improved releasable strap system 10 that has two separate parts, the hand strap 12 and a device strap 14. The hand strap 12 includes two portions, a straight wrist portion 24 and a curved looped portion 26. The loop portion 26 has two ends 28 and 30 connected to the straight wrist portion 24 at separated intervals. The curved loop portion 26 includes a first mating surface 32 of a hook and loop connector such as a VELCRO connecting system. The straight wrist portion includes a connector ring 34 or oval connector at one end and one mating surface 36 of a hook and loop connector means at the other end 36 with the second mating surface 40 of the hook and loop connector means positioned along the surface of the straight portion as shown in FIG. 3. The straight wrist portion 24 is wrapped around the wrist of a user and threaded through the ring 34 and tightened and folded back and locked in position as shown in FIG. 1 by mating the one mating surface 36 on the second mating surface 40.

Figure 4:
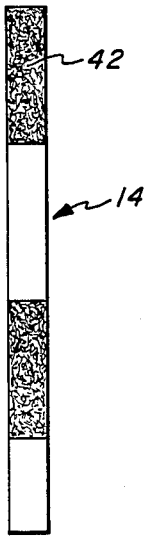
FIG. 4 shows the underside of the device strap.
Figure 5:
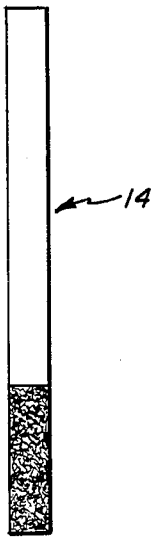
FIG. 5 shows the top side of the device strap.

A device strap 14 may be a straight band as shown in FIGS. 4 and 5 that includes a mating surface 42 of a hook and loop connector means on one side for releasably connecting the device strap 14 to the mating connector means 32 on the loop portion 26 of the hand strap 12. The device strap 14 also includes connector means 44 and 46 for connecting tools such as screwdriver 16 and other items to the device strap.

The hand strap is adapted to be inserted over the human wrist, hand and between two fingers. The hand strap can be placed over a glove on the user's hand.

For example, the releasable strap system may be used with ski poles apart from the glove device referred to in the U.S. patent application Serial No. 685,720. The device strap 14 disclosed in this case may be connected to the ski pole as shown in FIG. 1 of U.S. patent application Ser. No. 685,720 instead of wrapping the distal end around the ski pole as the screwdriver is shown to be connected in FIG. 1 of this disclosure. A strap may be composed of a vinyl or cloth base and may have one mating portion of a fastener material positioned on the bottom thereof. Fastener means may be the loop material portion of a VELCRO connector.

In this embodiment, a skier may connect the disclosed device over a glove. As the skier travels down a hill, the ski pole may be held even if it were to be dropped from the hand of the skier. The strap system will keep the ski pole connected to the skier by the strap device. If the ski pole becomes jammed between two rocks, the skier's hand will automatically move back with the pole as the remainder of the user's body continues down the hill on the skis. As the hand of the user moves backward, the strap device is able to be peeled away from the loop on the hand strap means as described in the prior patent application. As the body of the user continues forward and the hand and arm of the user moves backward relative to the moving body, the device strap is totally peeled away and the hand coverd by hand strap means over a glove is free to move down the mountain with the remainder of the person's body. In this manner, no injury will occur to the skier's hand and arm as with conventional ski straps coupled around a ski glove.

Further, the user may quickly peel away the device strap and replace it with another tool or a plurality of screws on another device strap for the user's convenience. This procedure reduces the number of times a user has to climb down a ladder to pick up items dropped from the user's hand.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A releasable strap system comprising:

a hand strap and a device strap said hand strap including a straight wrist portion and a curved generally U-shaped portion, said curved loop portion having two ends connected to the straight portion at separated intervals, said curved loop portion including a first mating surface of a hook and loop type connector, said straight wrist portion including a connector ring at one end and one mating surface of a hook and loop type connector at the other end and a second mating surface of the hook and loop type connector positioned along the surface of the straight portion, said straight portion being engageable around the wrist of a user, with at least one finger of the user's hand inserted through said curved loop portion, by threading the other end through said connector ring and folding back said one mating surface on said second mating surface for tightening and locking the straight portion to the wrist of the user, said device strap including a mating surface of the hook and loop type connector on one side for releasably connecting the device strap to the first mating surface of said curved loop portion, and said device strap including connector means for securing items thereto.

* * * * *